US006209423B1

(12) United States Patent
Shiao

(10) Patent No.: US 6,209,423 B1
(45) Date of Patent: Apr. 3, 2001

(54) RATCHET SPANNER

(76) Inventor: Hsuan-Sen Shiao, No. 15-1, La. 369, Min-Chuan Rd., Taichung City (TW)

( * ) Notice: Subject to any disclaimer, the term of this patent is extended or adjusted under 35 U.S.C. 154(b) by 0 days.

(21) Appl. No.: 09/539,276

(22) Filed: Mar. 30, 2000

(51) Int. Cl.[7] ..... B25B 13/46

(52) U.S. Cl. ..... 81/62; 192/43.1

(58) Field of Search ..... 81/60, 62; 192/43.1

(56) References Cited

U.S. PATENT DOCUMENTS 5,794,496 * 8/1998 Arnold ..... 81/62 X
5,913,954 * 6/1999 Arnold et al. ..... 81/62 X

* cited by examiner

*Primary Examiner*—James G. Smith
(74) *Attorney, Agent, or Firm*—Sheridan Ross P.C.

(57) ABSTRACT

A ratchet spanner includes a spanner body with a head portion confined by a peripheral wall. Top and bottom flanges extend inwardly and radially from top and bottom ends of the peripheral wall. The top flange has a curved inner peripheral surface with an open-end slot. The bottom flange defines a bottom opening, and is formed with an inward flange extending from an inner peripheral surface thereof. An insert member is inserted into the head portion, and has a curved shoulder between upper and lower portions thereof. The upper portion of the insert member is formed with an open-ended slot. The curved shoulder abuts against the top flange of the head portion for preventing upward removal therefrom. A ratchet wheel is rotatably disposed in the head portion, and has an upper annular groove and a lower shoulder abutting against the inward flange of the head portion for preventing downward removal therefrom. A C-shaped ring engages the annular groove in the ratchet wheel, the open-ended slot in the head portion, and the open-ended slot of the insert member for preventing removal of the ratchet wheel and the insert member from the head portion. A pawl control element is disposed in the head portion and permits rotation of the ratchet wheel in a selected one of two directions.

9 Claims, 8 Drawing Sheets

RATCHET SPANNER

BACKGROUND OF THE INVENTION

1. Field of the Invention

The present invention relates to a ratchet spanner, more particularly to a ratchet spanner which includes components that can be easily assembled during the manufacturing process thereof and which requires little operating space to operate the same.

2. Description of the Related Art

Referring to FIGS. 1 and 2, a conventional ratchet spanner is shown to include a spanner body 1 and a ratchet mechanism. The spanner body 1 has an annular head portion 101 defining a ratchet accommodating chamber 102 with a lower end opening. The ratchet mechanism includes a ratchet wheel 105 disposed rotatably in a front section 103 of the chamber 102 via the lower end opening such that a tool mounting shank 105" of the ratchet wheel 105 projects outwardly of the chamber 102. Two spring-biased pawls 107 and a pawl actuator 106 are disposed in a rear section 104 of the chamber 102 and are operably connected to the ratchet wheel 105. The pawl actuator 106 can be manually operated in either one of two directions in order to engage a selected one of the pawls 107 with the ratchet wheel 105 such that the conventional ratchet spanner is turnable in only a single direction when in operation.

Some of the drawbacks of the aforementioned conventional ratchet spanner are as follows:

It is somewhat difficult to assemble the components of the aforesaid ratchet spanner. During assembly, after the ratchet wheel 105, the spring-biased pawls 107 and the pawl actuator 106 are mounted in the chamber 102, a cover shield 109 is mounted on the spanner body 1 by the use of screws 109' to prevent downward removal of the ratchet wheel 105 from the head portion 101 of the spanner body 1. As such, a relatively long assembly time is incurred.

In addition, because the ratchet wheel 105 has a relatively small number of teeth 105' with great pitches, in order to ensure engagement between a rectangular end 107' of the pawls 107 and the teeth 105 ' of the ratchet wheel 105, a large amount of operating space is needed for turning of the spanner body 1.

Referring to FIGS. 3 and 4, another conventional ratchet spanner is shown to include a spanner body 2 and a ratchet mechanism. The spanner body 2 includes an annular head portion 201 which has a peripheral wall 201A with top and bottom ends and an opening 202 formed through the top and bottom ends, and top and bottom flanges that extend radially and inwardly from the top and bottom ends. The ratchet mechanism includes a ratchet wheel 205 that is disposed rotatably within the opening 202 in the head portion 201 and that defines a tool accommodating cavity at the central portion thereof, a pawl unit 206 disposed within the opening 202, and a spring unit 207 that is disposed within a retention bore 204 formed in the peripheral wall 201A and that biases the pawl unit 206 to engage teeth 205 ' of the ratchet wheel 205.

Because the ratchet wheel 205 is provided with densely located fine profile teeth 205 ', only a small amount of operating space is required to operate the aforesaid conventional spanner. However, during the manufacture of the ratchet wheel 205, high precision and great skill are needed to produce such type of fine profile teeth 205'. A high manufacturing cost is thus incurred.

During mass production, a curved recess 203 is firstly formed in the peripheral wall 201A. The retention bore 204 is then formed by a milling unit and a drilling unit. Since only a small-diameter cutting tool can be used in order to form the retention bore 204 with a relative depth, the cutting tool easily breaks under high speeds of rotation, thereby inconveniencing the operator.

SUMMARY OF THE INVENTION

Therefore, the object of this invention is to provide a ratchet spanner which includes components that are easily manufactured and assembled during the manufacturing process and which requires a relatively small amount of space to operate the same.

Accordingly, a ratchet spanner of the present invention includes a spanner body, a stepped insert member, a vertical cylindrical ratchet wheel, a spring-biased pawl assembly, and a control element. The spanner body has a head portion and a handle, which has an end connected fixedly to the head portion. The head portion has a peripheral wall with a top end and a bottom end, a top flange that extends integrally and inwardly from the top end of the peripheral wall, and a bottom flange that extends integrally and inwardly from the bottom end of the peripheral wall. The top flange defines a top opening therein, and has a curved and slotted inner peripheral surface with an open-ended slot that extends circumferentially therealong. The bottom flange has a circular inner peripheral surface, which is formed with an inward flange that extends integrally, radially and inwardly from a bottom end of the circular inner peripheral surface and that defines a bottom opening therein. The insert member is inserted into the head portion of the spanner body between the top and bottom flanges. The insert member has a lower portion with a top surface, an upper portion that extends integrally and upwardly from the top surface of the lower portion, and a curved shoulder defined between the upper and lower portions. The upper portion of the insert member has a curved side surface, which is formed with an open-ended slot that extends circumferentially therealong and that cooperates with the open-ended slot in the head portion to form an annular slot unit. The upper portion of the insert member extends into the top opening in the head portion of the spanner body. The curved shoulder of the insert member abuts against the top flange of the head portion of the spanner body for preventing upward removal of the insert member from the head portion. The lower portion of the insert member has a side surface with two chamber units and abuts against the bottom flange for preventing downward removal of the insert member from the head portion of the spanner body. The ratchet wheel is disposed rotatably within the head portion of the spanner body. The ratchet wheel has a diameter-reduced bottom end that extends into the bottom opening in the head portion of the spanner body and that defines a circular shoulder, a toothed portion with a plurality of ratchet teeth, and a top end portion that is formed with an annular groove. The circular shoulder of the ratchet wheel abuts against the inward flange of the head portion of the spanner body for preventing downward removal of the ratchet wheel from the head portion of the spanner body. A C-shaped retaining ring is disposed in the head portion of the spanner body in such a manner that the ring engages the annular groove in the ratchet wheel, the open-ended slot in the head portion and the open-ended slot in the insert member for preventing removal of the ratchet wheel and the insert member from the head portion of the spanner body. The pawl assembly includes a first pawl unit and a second pawl unit, which are received respectively within the chamber units in the insert member and which are biased by a spring action to engage the toothed portion of the ratchet wheel. Engagement between the toothed portion of the ratchet wheel and the first pawl unit prevents rotation of the ratchet wheel within the head portion of the spanner body in a first direction. Engagement between the toothed portion of the ratchet wheel and the second pawl unit prevents rotation of the ratchet wheel within the head portion of the spanner body in a second direction that is opposite to the first direction. The control element is mounted operably on the insert member such that the control element presses selectively against one of the first and second pawl units against the spring action, thereby permitting rotation of the ratchet wheel within the head portion of the spanner body in a selected one of the first and second directions.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
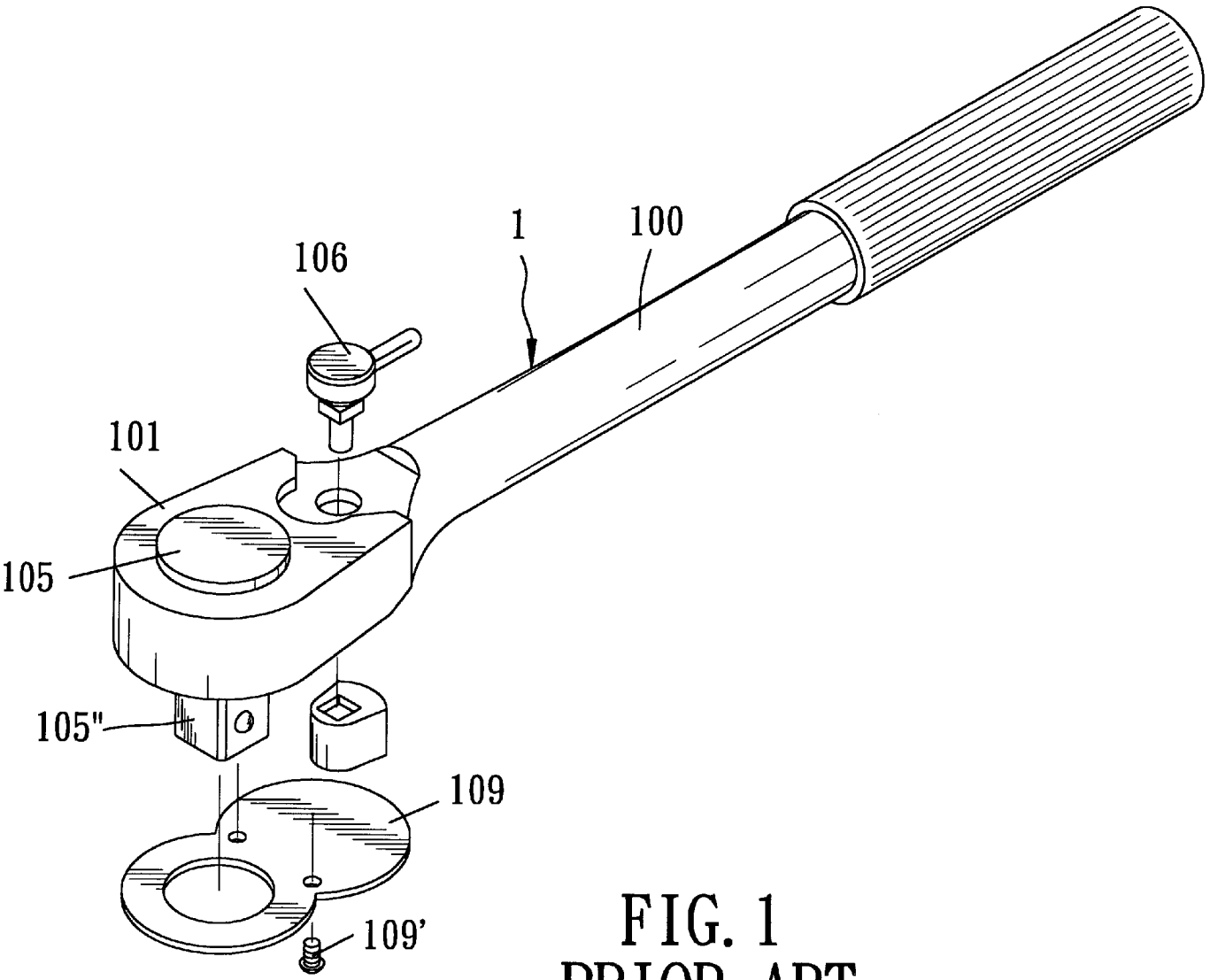
FIG. 1 PRIOR ART
FIG. 1 is a partly exploded perspective view of a conventional ratchet spanner.
Figure 2:
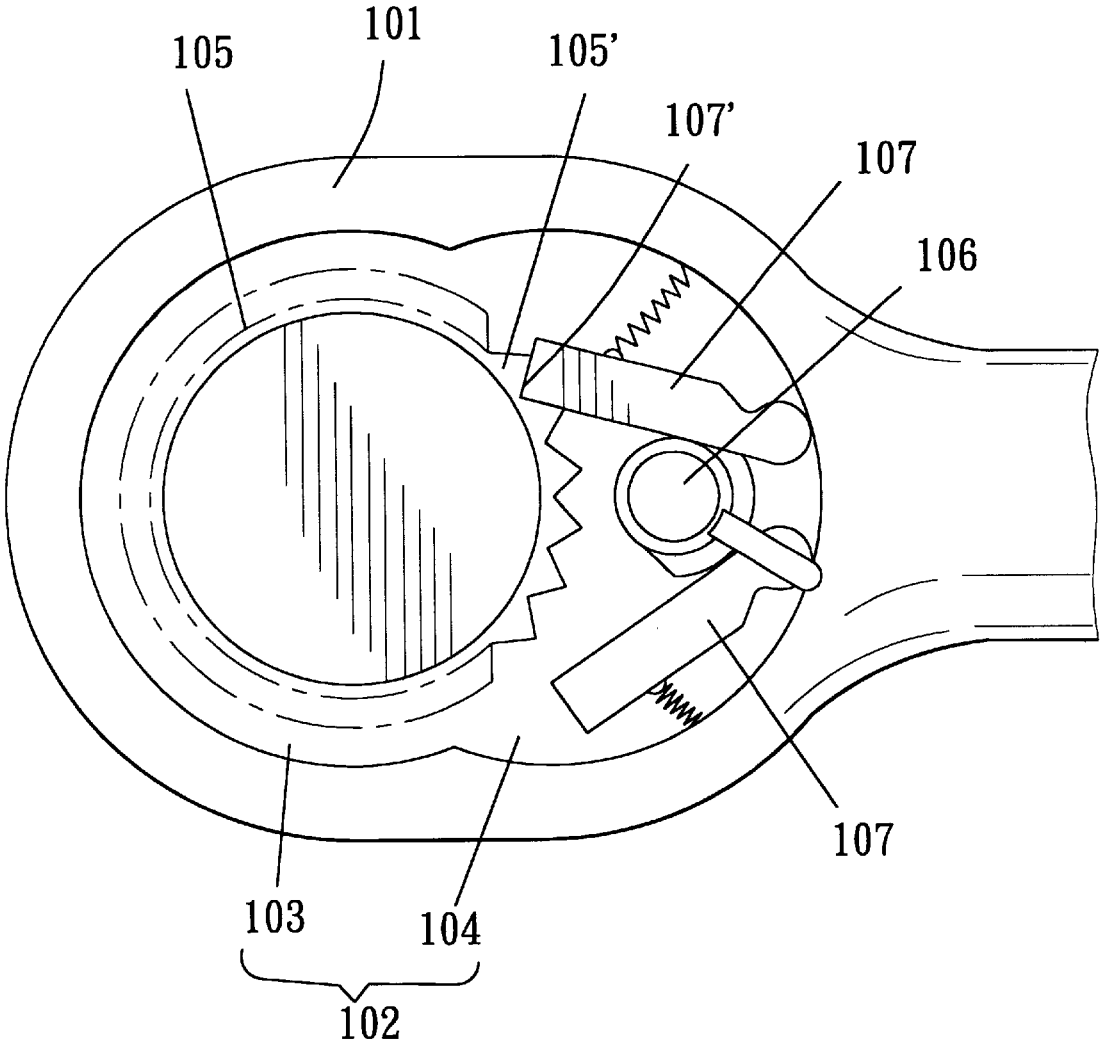
FIG. 2 PRIOR ART
FIG. 2 is a schematic top view of the conventional ratchet spanner, illustrating how a spring-biased pawl unit engages a ratchet wheel.
Figure 3:
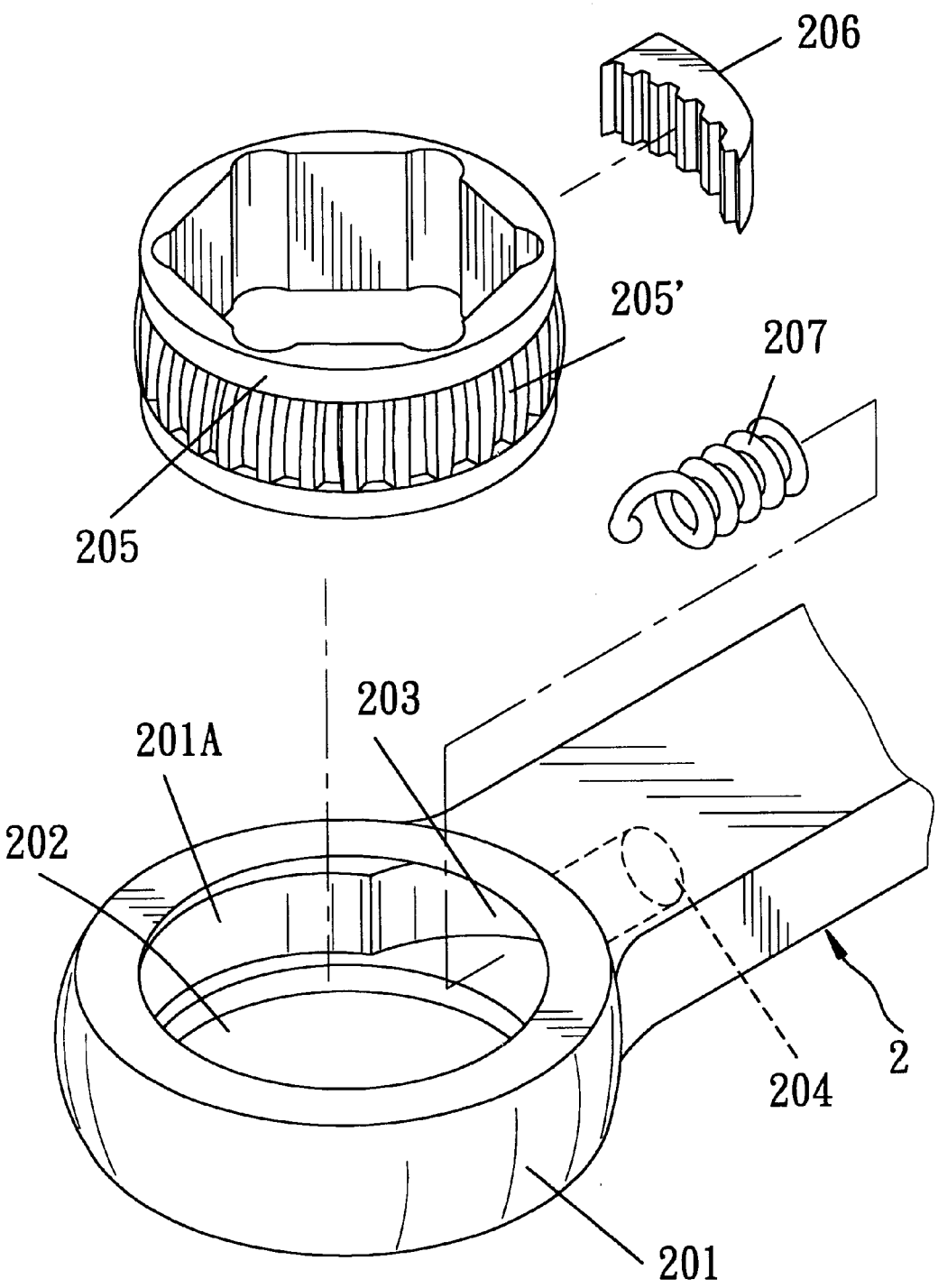
FIG. 3 PRIOR ART
FIG. 3 shows a partly exploded fragmentary perspective view of another conventional ratchet spanner.
Figure 4:
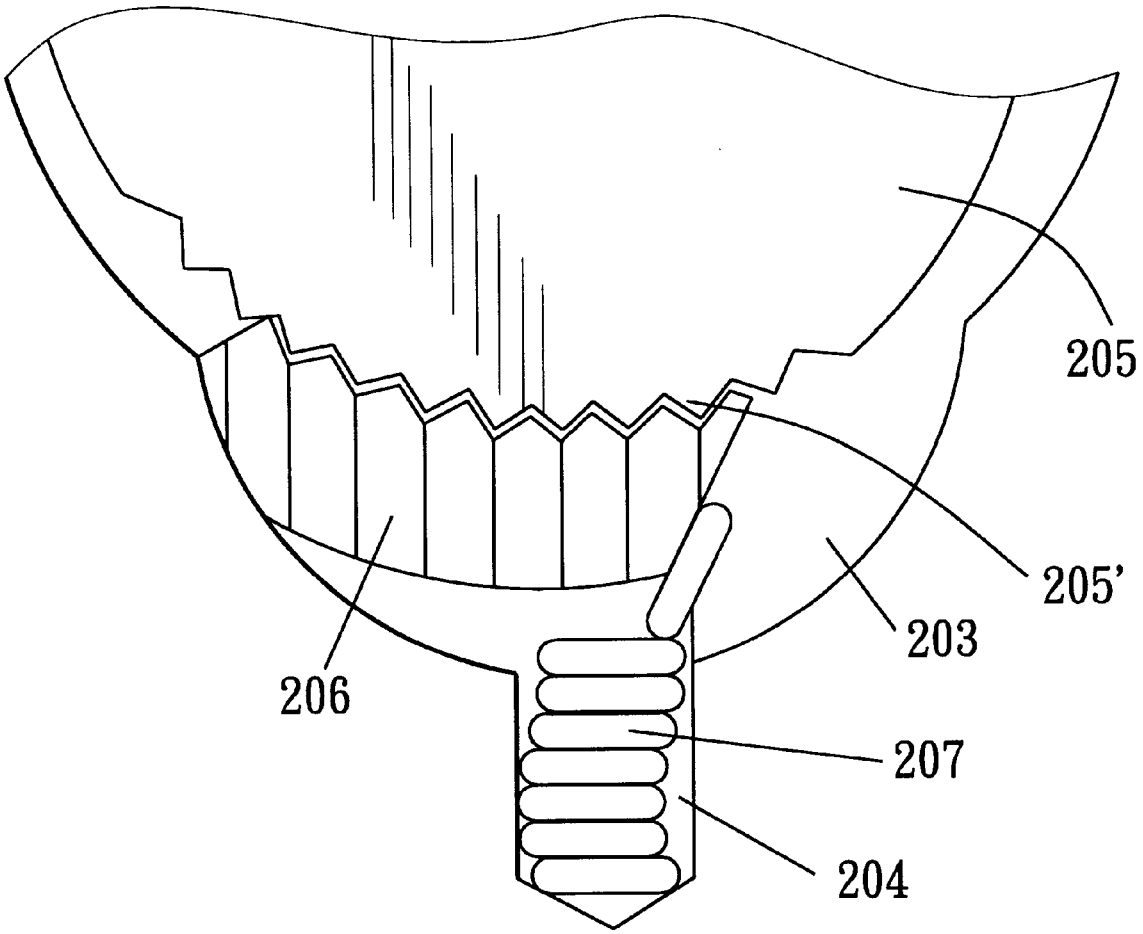
FIG. 4 PRIOR ART
FIG. 4 is a fragmentary schematic view of the conventional ratchet spanner shown in FIG. 3, illustrating how a spring-biased pawl unit engages a ratchet wheel.
Figure 5:
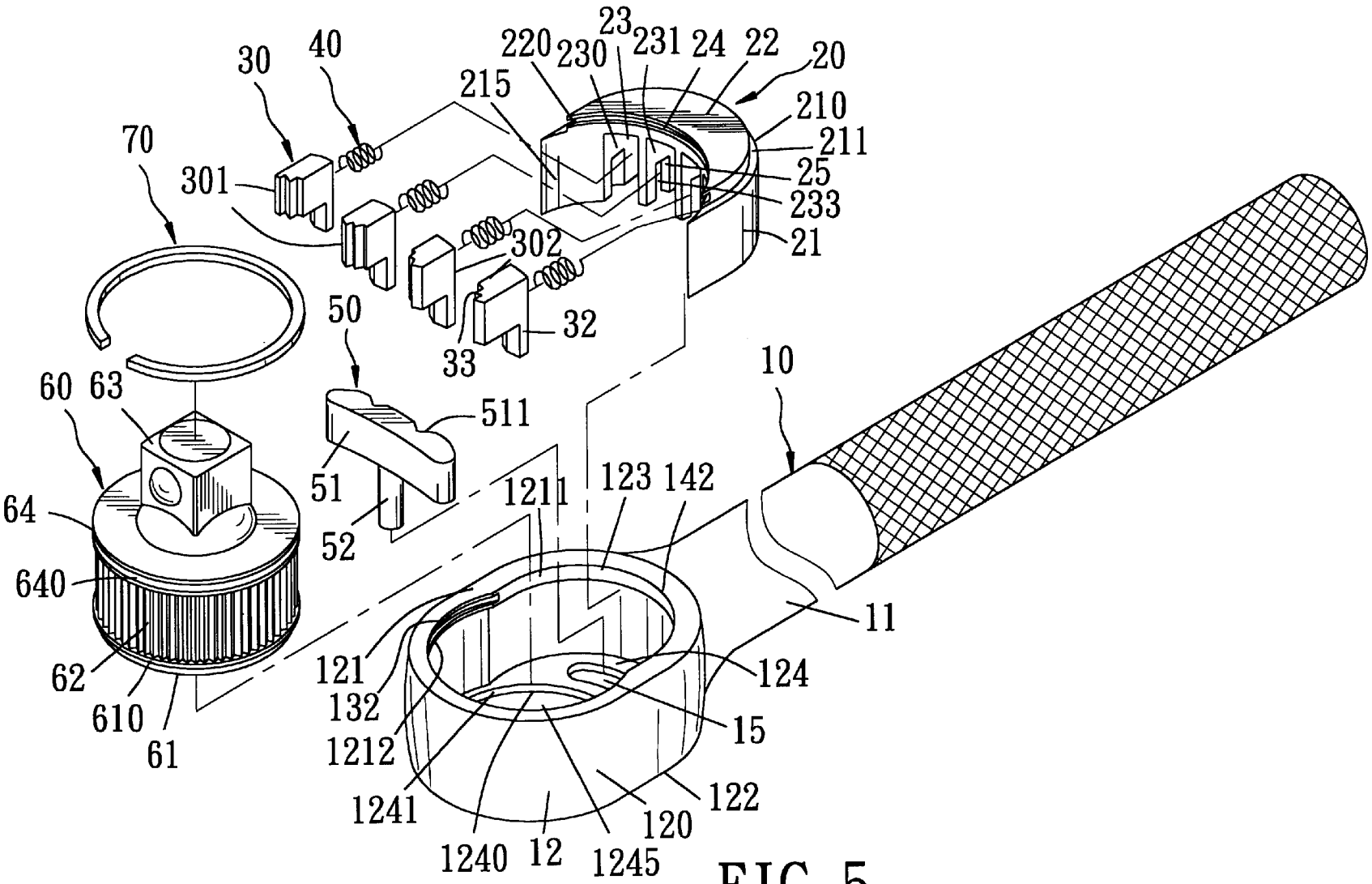
FIG. 5 is an exploded perspective view of the preferred embodiment of a ratchet spanner of the present invention.
Figure 6:
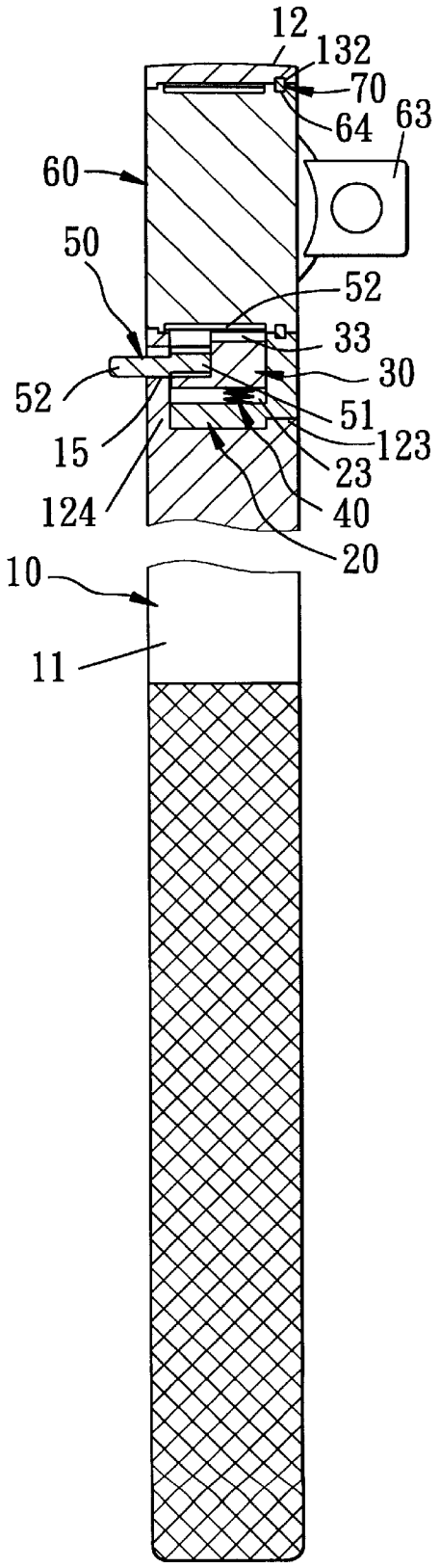
FIG. 6 is a partly sectional schematic side view of the preferred embodiment.
Figure 7:
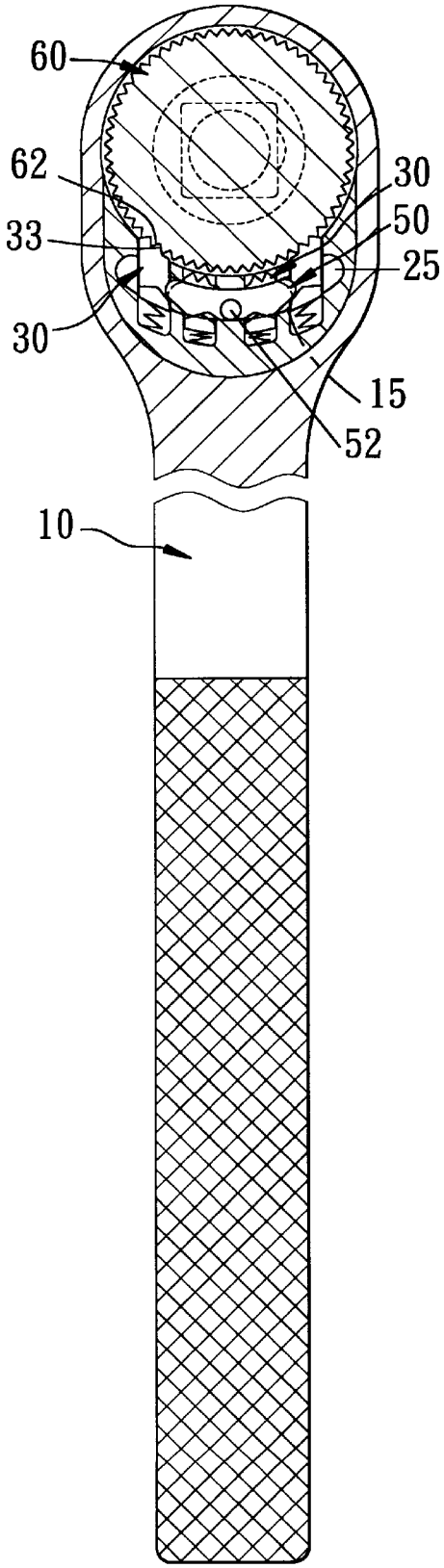
FIG. 7 is a partly sectional schematic top view of the preferred embodiment, illustrating how a plurality of spring-biased pawl units and a pawl control element are disposed in an end portion of a spanner body.

Referring to FIGS. 5,6 and 7, the preferred embodiment of a ratchet spanner of the present invention is shown to include a spanner body 10, a stepped insert member 20, a vertical cylindrical ratchet wheel 60, a C-shaped retaining ring 70, a spring-biased pawl assembly, and a pawl control element 50.

As illustrated, the spanner body 10 has a head portion 12 and a handle 11, which has an end connected fixedly to the head portion 12. The head portion 12 has aperipheral wall 120 with a top end 121 and a bottom end 122, a top flange 123 that extends integrally and inwardly from the top end 121 of the peripheral wall 120, and a bottom flange 124 that extends integrally and inwardly from the bottom end 122 of the peripheral wall 120. The top flange 123 defines a top opening 1211 therein, and has a curved and slotted inner peripheral surface 1212 with an open-ended slot 132 that extends circumferentially therealong. The bottom flange 124 has a circular inner peripheral surface 1240, which is formed with an inward flange 1241 that extends integrally, radially and inwardly from a bottom end of the circular inner peripheral surface 1240 and that defines a bottom opening 1245 therein.

The insert member 20 is inserted into the head portion 12 of the spanner body 10 between the top and bottom flanges 123, 124. The insert member 20 has a lower portion 21 with a top surface 210, an upper portion 22 that extends integrally and upwardly from the top surface 210 of the lower portion 21, and a curved shoulder 211 defined between the upper and lower portions 22,21. The upper portion 22 has a curved side surface 220, which is formed with an open-ended slot 24 that extends circumferentially therealong and that cooperates with the open-ended slot 132 in the head portion 12 of the spanner body 10 to form an annular slot unit. The upper portion 22 extends into the top opening 1211 in the head portion 12 of the spanner body 10. Under such a condition, the curved shoulder 211 of the insert member 20 abuts against the top flange 123 of the head portion 12 of the spanner body 10 for preventing upward removal of the insert member 20 from the head portion 12 of the spanner body. The lower portion 21 further has a side surface 215 that is formed with two chamber units 23 and that abuts against the bottom flange 124 of the head portion 12 for preventing downward removal of the insert member 20 from the head portion 12 of the spanner body 10.

The cylindrical ratchet wheel 60 is disposed rotatably within the head portion 12 of the spanner body 10, and has a diameter-reduced bottom end 61 that extends into the bottom opening 1245 in the head portion 12 and that defines a circular shoulder 610, a toothed portion 62 with a plurality of ratchet teeth, and a top end portion 64. The top end portion 64 of the ratchet wheel 60 is formed with an annular groove 640. The circular shoulder 610 of the ratchet wheel 60 abuts against the inward flange 1241 of the head portion 12 for preventing downward removal of the ratchet wheel 60 from the head portion 12 of the spanner body 10.

The C-shaped retaining ring 70 is disposed in the head portion 12 in such a manner that the retaining ring 70 engages the annular groove 640 in the ratchet wheel 60, the open-ended slot 132 in the head portion 12 of the spanner body 10, and the open-ended slot 24 in the insert member 20 for preventing removal of the ratchet wheel 60 and the insert member 20 from the head portion 12 of the spanner body 10.

The pawl assembly 30 includes a first pawl unit 301 and a second pawl unit 302, which are received respectively within the chamber units 23 in the insert member 20 and which are biased by spring units 40 to engage the toothed portion of the ratchet wheel 60. Under such a condition, engagement between the toothed portion of the ratchet wheel 60 and the first pawl unit 301 prevents rotation of the ratchet wheel 60 within the head portion 12 of the spanner body 10 in a first direction. Engagement between the toothed portion of the ratchet wheel 60 and the second pawl unit 302 prevents rotation of the ratchet wheel 60 within the head portion 12 of the spanner body 10 in a second direction opposite to the first direction.

The control element 50 is mounted operably on the insert member 20 and presses selectively against one of the first and second pawl units 301, 302 against the action of the spring units 40. Under this state, the ratchet wheel 60 within the head portion 12 is permitted to rotate in a selected one of the first and second directions.

Figure 9:
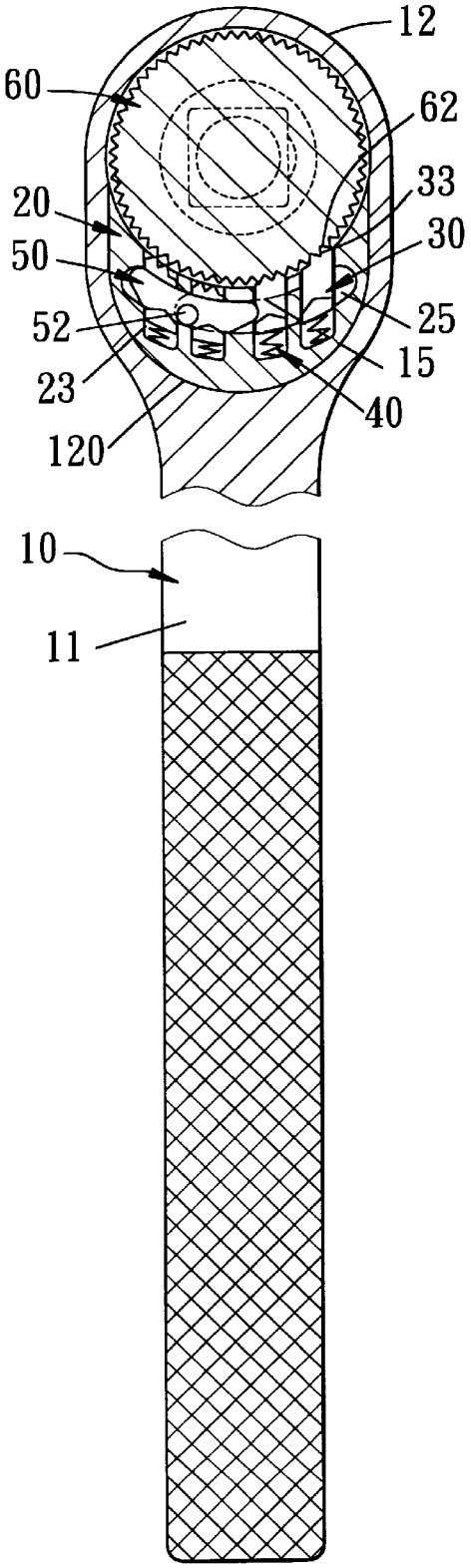
FIG. 9 is a partly sectional schematic top view of the preferred embodiment, illustrating a second state where the ratchet wheel is turnable relative to the spanner body in a second direction.
Figure 8:
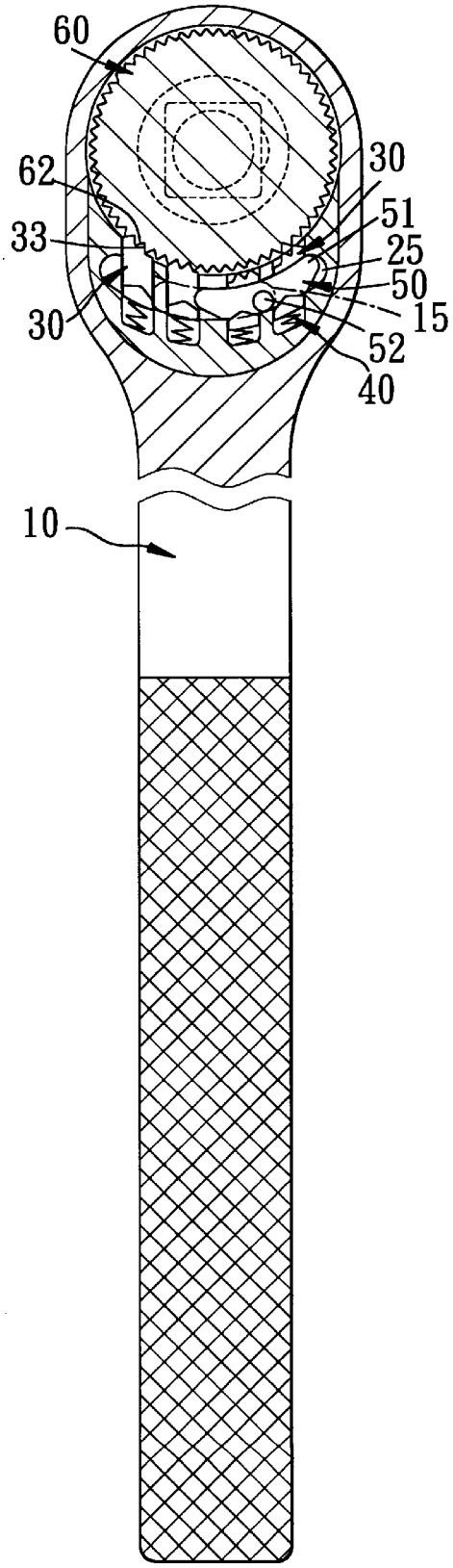
FIG. 8 is a partly sectional schematic top view of the preferred embodiment, illustrating a first state where a ratchet wheel is turnable relative to a spanner body in a first direction.

The insert member 20 is further formed with a slide slot unit 25 that extends across the chamber units 23 and which receives slidably the control element 50 therein. The control element 50 can slide into a selected one of the chamber units 23 in the insert member 20 so as to press against a corresponding one of the first and second pawl units 301, 302. Under such a condition, the ratchet wheel 60 is permitted to rotate within the head portion 12 of the spanner body 10 in the selected direction. Preferably, the control element 50 includes a slide piece 51 formed with two spaced stop grooves 511 which selectively engage the stops 32 of one of the first and second pawl units 301, 302. Under this condition, the stop teeth 33 of the other one of the first and second pawl units 301, 302 engage the toothed portion of the ratchet wheel 60, as best shown in FIGS. 8 and 9, such that the ratchet wheel 60 is permitted to rotate in the selected direction. Referring to FIG. 7, when the control element 50 is moved in the chamber units 23 so as to be at an intermediate position of the slot unit 25, the stops 32 of an adjacent pair of the first and second pawl units 301, 302 respectively engage the stop grooves 511 of the control element 5. Under this condition, the ratchet wheel 60 is prevented from rotation such that the ratchet spanner of the present invention serves as a conventional spanner.

In the preferred embodiment, the bottom flange 124 of the head portion 12 is formed with a curved rod hole 15 therethrough. In order to facilitate manual actuation of the control element 50, the latter is provided with an actuation rod 52 that extends integrally from the slide piece 51 and through the rod hole 15 in the bottom flange 124 for actuation by the fingers of the operator. Preferably, the chamber units 23 include four chambers 230. The first pawl unit 301 includes two first pawl members that are received within two of the four chambers 230. The second pawl unit 302 includes two second pawl members that are received within another two of the four chambers 230. The chambers 230 are arranged in a row along the slide slot unit 25. The insert member 20 further includes three partitions 231, each of which is disposed between an adjacent pair of the chambers 230. Each of the partitions 231 has a notch 233 that forms a portion of the slide slot unit 25. Preferably, the ratchet wheel 60 has an end surface that is formed integrally with a post 63 of a rectangular cross-section such that a socket (not shown) for turning of a workpiece can be mounted thereon.

Figure 11:
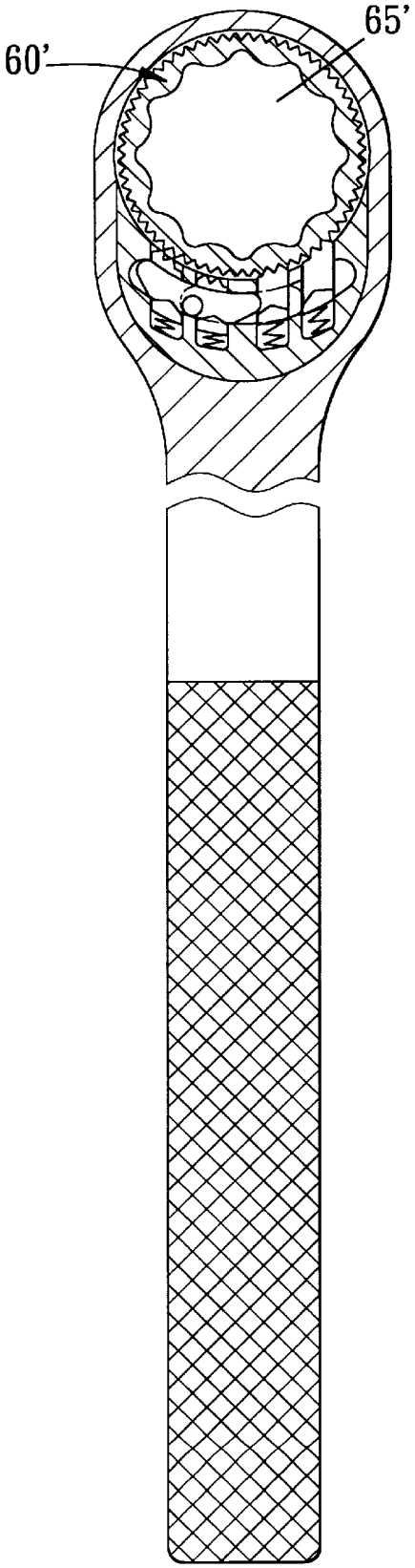
FIG. 11 is a partly sectional schematic top view of yet another modified preferred embodiment, illustrating a state where the ratchet wheel is turnable relative to the spanner body in only one direction.

Referring to FIG. 11, a second preferred embodiment is shown to be is similar to the first preferred embodiment in structure, except that the ratchet wheel 60 ' has an end surface formed with a hexagonal hole 65 ' for receiving an operating tool or hexagonal head of a bolt therein (not shown).

Figure 10:
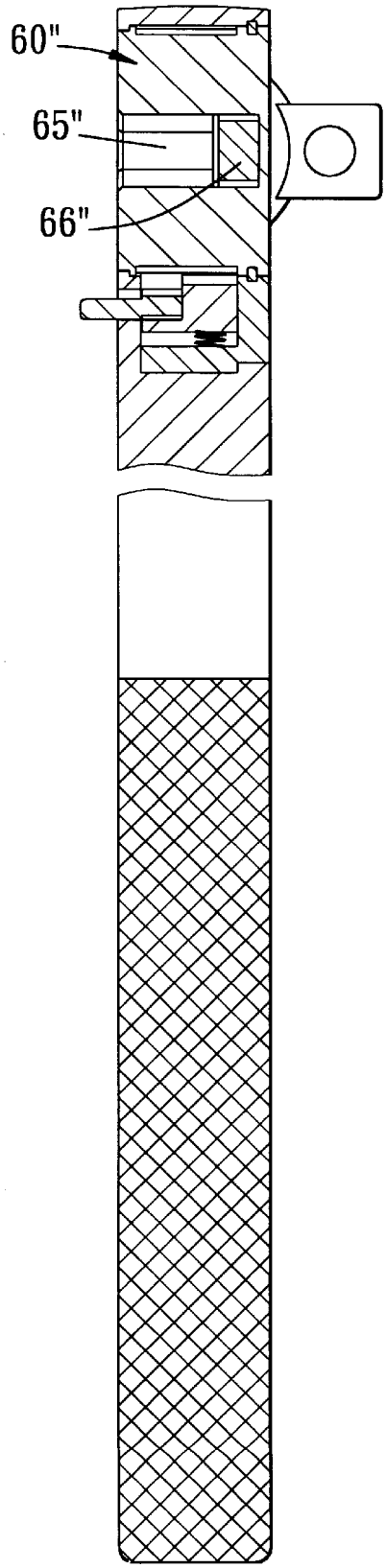
FIG. 10 is a partly sectional schematic side view of a modified preferred embodiment.

Referring to FIG. 10, a third preferred embodiment is shown to be similar to the first preferred embodiment in structure, except that the ratchet wheel 60" is annular-shaped, and has a splined inner cavity 65" for receiving an operating tool (not shown) therein. A magnetic piece 66 ' is mounted fixedly in an innermost wall of the cavity 65" for attracting with the operating tool so as to prevent untimely removal of the same.

The advantages that result from the use of the aforesaid ratchet spanner of this invention are as follows:

Since the pawl members 30 are constantly biased by spring units 40 in a radial direction with respect to the ratchet wheel 60, engagement of the pawl members with the ratchet wheel 60 is ensured. The fine profile teeth on the ratchet wheel 60 further ensure that only little space is required when operating the ratchet spanner of the present invention.

The top and bottom flanges 123, 124 in the head portion 12 of the spanner body 10, and the ratchet accommodating bore between the top and bottom flanges 123, 124 can be formed by a large-diameter milling tool, which does not easily break during the machining process.

With this invention thus explained, it is apparent that numerous modifications and variations can be made without departing from the scope and spirit of this invention. It is therefore intended that the invention be limited only as indicated in the appended claims.

I claim:

1. A ratchet spanner comprising:

a spanner body having a head portion and a handle, which has an end connected fixedly to said head portion, said head portion having a peripheral wall with a top end and a bottom end, a top flange extending integrally and inwardly from said top end of said peripheral wall, and a bottom flange extending integrally and inwardly from said bottom end of said peripheral wall, said top flange defining a top opening therein and having a curved and slotted inner peripheral surface with an open-ended slot that extends circumferentially therealong, said bottom flange having a circular inner peripheral surface, which is formed with an inward flange that extends integrally, radially and inwardly from a bottom end of said circular inner peripheral surface and that defines a bottom opening therein;

a stepped insert member inserted into said head portion of said spanner body between said top and bottom flanges, and having a lower portion with a top surface, an upper portion extending integrally and upwardly from said top surface of said lower portion, and a curved shoulder defined between said upper and lower portions, said upper portion having a curved side surface, which is formed with an open-ended slot that extends circumferentially therealong and that cooperates with said open-ended slot in said head portion of said spanner body to form an annular slot unit, said upper portion extending into said top opening in said head portion of said spanner body, said curved shoulder of said insert member abutting against said top flange of said head portion of said spanner body for preventing upward removal of said insert member from said head portion of said spanner body, said lower portion having a side surface with two chamber units and abutting against said bottom flange for preventing downward removal of said insert member from said head portion of said spanner body;

a vertical cylindrical ratchet wheel disposed rotatably within said head portion of said spanner body, and having a diameter-reduced bottom end that extends into said bottom opening in said head portion of said spanner body and that defines a circular shoulder, a toothed portion with a plurality of ratchet teeth, and a top end portion that is formed with an annular groove, said circular shoulder of said ratchet wheel abutting against said inward flange of said head portion of said spanner body for preventing downward removal of said ratchet wheel from said head portion of said spanner body;

a C-shaped retaining ring engaging said annular groove in said ratchet wheel, said open-ended slot in said head portion of said spanner body and said open-ended slot in said insert member for preventing removal of said ratchet wheel and said insert member from said head portion of said spanner body;

a spring-biased pawl assembly including a first pawl unit and a second pawl unit, which are received respectively within said chamber units in said insert member and which are biased by a spring action to engage said toothed portion of said ratchet wheel, engagement between said toothed portion and said first pawl unit preventing rotation of said ratchet wheel within said head portion of said spanner body in a first direction, engagement between said toothed portion and said second pawl unit preventing rotation of said ratchet wheel within said head portion of said spanner body in a second direction that is opposite to said first direction; and a pawl control element mounted operably on said insert member and pressing selectively against one of said first and second pawl units against the spring action, thereby permitting rotation of said ratchet wheel within said head portion of said spanner body in a selected one of said first and second directions.

2. The ratchet spanner as claimed in claim 1, wherein said insert member is formed with a slide slot unit that extends across said chamber units and that receives slidably said control element therein, whereby said control element can slide into a selected one of said chamber units in said insert member so as to press against a corresponding one of said first and second pawl units, thereby permitting rotation of said ratchet wheel within said head portion of said spanner body in the selected one of said first and second directions.

3. The ratchet spanner as claimed in claim 2, wherein said bottom flange of said spanner body is formed with a rod hole therethrough, said control element being formed with an integral actuation rod that extends through said rod hole in said bottom flange.

4. The ratchet spanner as claimed in claim 2, wherein said chamber units include four chambers, said first pawl unit including two first pawl members that are received within two of said four chambers, said second pawl unit including two second pawl members that are received within another two of said four chambers.

5. The ratchet spanner as claimed in claim 4, wherein said chambers are arranged in a row, said insert member including three partitions, each of which is disposed between an adjacent pair of said chambers, each of said partitions having a notch that forms a portion of said slide slot unit.

6. The ratchet spanner as claimed in claim 1, wherein said ratchet wheel is annular, and has a splined inner surface.

7. The ratchet spanner as claimed in claim 1, wherein said ratchet wheel has an end surface that is formed integrally with a post of a rectangular cross-section.

8. The ratchet spanner as claimed in claim 1, wherein said ratchet wheel has an end surface that is formed with a hexagonal hole.

9. The ratchet spanner as claimed in claim 1, wherein said ratchet wheel is provided with a magnet that is secured therein.

* * * * *